US010557597B2

(12) United States Patent
Hendricks

(10) Patent No.: US 10,557,597 B2
(45) Date of Patent: Feb. 11, 2020

(54) SEMICONDUCTIVE DECORATIVE LIGHTING HAVING A NATURAL LIGHT EFFECT

(71) Applicant: Shining Sea Trading Company, West Valley City, UT (US)

(72) Inventor: Jared Hendricks, Draper, UT (US)

(73) Assignee: Shining Sea Trading Company, West Valley City, UT (US)

( * ) Notice: Subject to any disclaimer, the term of this patent is extended or adjusted under 35 U.S.C. 154(b) by 86 days.

(21) Appl. No.: 15/872,987

(22) Filed: Jan. 17, 2018

(65) Prior Publication Data

US 2018/0245752 A1 Aug. 30, 2018

Related U.S. Application Data

(60) Provisional application No. 62/446,816, filed on Jan. 16, 2017.

(51) Int. Cl.

| | |
|---|---|
| ***F21S 4/10*** | (2016.01) |
| ***F21V 3/02*** | (2006.01) |
| ***F21V 23/06*** | (2006.01) |
| ***F21W 121/00*** | (2006.01) |
| ***F21Y 115/10*** | (2016.01) |
| ***F21Y 115/30*** | (2016.01) |

(52) U.S. Cl.

CPC ..... *F21S 4/10* (2016.01); *F21V 3/02* (2013.01); *F21V 23/06* (2013.01); *F21W 2121/00* (2013.01); *F21Y 2115/10* (2016.08); *F21Y 2115/30* (2016.08)

(58) Field of Classification Search

CPC ... F21S 10/04; F21S 4/10; F21S 6/001; F21V 3/02; G02B 6/0096

USPC ..... 362/249.16

See application file for complete search history.

(56) References Cited

U.S. PATENT DOCUMENTS

| | | | | |
|---|---|---|---|---|
| 8,628,220 | B2 * | 1/2014 | Boonekamp | F21V 7/0091 362/305 |
| 2007/0091633 | A1 * | 4/2007 | Harrity | F21S 6/001 362/551 |
| 2009/0103287 | A1 * | 4/2009 | Medley | F21S 6/001 362/122 |
| 2010/0208488 | A1 * | 8/2010 | Luo | F21V 7/0091 362/555 |

(Continued)

*Primary Examiner* — William N Harris

(74) *Attorney, Agent, or Firm* — Thorpe North & Western, LLP

(57) ABSTRACT

A decorative lighting device is presented and described. The device includes a translucent post configured to propagate light from an LED at a basal end along a linear axis to an apical end of the translucent post when in use, the translucent post comprising a center emission surface at the apical end on the linear axis configured to emit a center portion of light, a circumferential emission surface obliquely oriented relative to the linear axis between the LED and the center emission surface configured to emit a circumferential portion of the light, and a radially-oriented emission surface extending along the translucent post between the basal end and the circumferential emission surface configured to emit a radial portion of the light, wherein as light from the light is propagated through the translucent post, the radial, circumferential, and center portions of the light are emitted to create an incandescent visual effect.

19 Claims, 6 Drawing Sheets

(56) References Cited

U.S. PATENT DOCUMENTS

2012/0106146 A1* 5/2012 Hao ..... F21V 3/063
362/235
2012/0268938 A1* 10/2012 Peng ..... F21V 17/12
362/249.06

* cited by examiner

SEMICONDUCTIVE DECORATIVE LIGHTING HAVING A NATURAL LIGHT EFFECT

PRIORITY DATA

This application claims the benefit of U.S. Provisional Patent Application Ser. No. 62/446,816, filed Jan. 16, 2017, which is incorporated herein by reference.

BACKGROUND

Decorative lighting is often used to enhance the aesthetic feel of many indoor and outdoor locations. Such lighting can be year-round, seasonal, holiday-related, event-related, and the like. In one example, decorative lighting can be used as a holiday embellishment to decorate interiors, exteriors, trees and shrubs, landscaping structures, floats, displays, and the like.

BRIEF DESCRIPTION OF THE DRAWINGS

These drawings are provided to illustrate various aspects of the invention and are not intended to be limiting of the scope in terms of dimensions, materials, configurations, arrangements or proportions unless otherwise limited by the claims.

DESCRIPTION OF EMBODIMENTS

Figure 1A:
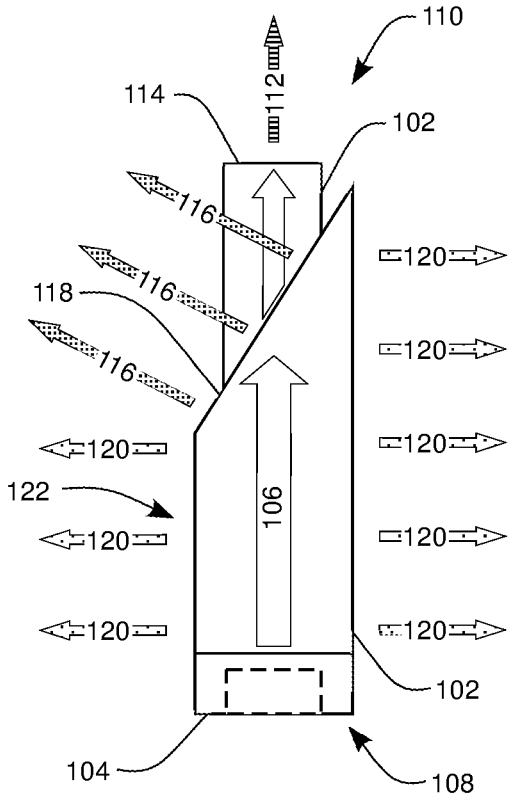
FIG. 1A illustrates a view of a translucent post in accordance with one example of the present disclosure.

Although the following detailed description contains many specifics for the purpose of illustration, a person of ordinary skill in the art will appreciate that many variations and alterations to the following details can be made and are considered to be included herein.

Accordingly, the following embodiments are set forth without any loss of generality to, and without imposing limitations upon, any claims set forth. It is also to be understood that the terminology used herein is for the purpose of describing particular embodiments only, and is not intended to be limiting. Unless defined otherwise, all technical and scientific terms used herein have the same meaning as commonly understood by one of ordinary skill in the art to which this disclosure belongs.

In this disclosure, "comprises," "comprising," "containing" and "having" and the like can have the meaning ascribed to them in U.S. Patent law and can mean "includes," "including," and the like, and are generally interpreted to be open-ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the compositions nature or characteristics would be permissible if present under the "consisting essentially of" language, even though not expressly recited in a list of items following such terminology. When using an open-ended term in this specification, like "comprising" or "including," it is understood that direct support should be afforded also to "consisting essentially of" language as well as "consisting of" language as if stated explicitly and vice versa.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein.

As used herein, "enhanced," "improved," "performance-enhanced," "upgraded," and the like, when used in connection with the description of a device or process, refers to a characteristic of the device or process that provides measurably better form or function as compared to previously known devices or processes. This applies both to the form and function of individual components in a device or process, as well as to such devices or processes as a whole.

As used herein, "coupled" refers to a relationship of physical connection or attachment between one item and another item, and includes relationships of either direct or indirect connection or attachment. Any number of items can be coupled, such as materials, components, structures, layers, devices, objects, etc.

As used herein, "directly coupled" refers to a relationship of physical connection or attachment between one item and another item where the items have at least one point of direct physical contact or otherwise touch one another. For example, when one layer of material is deposited on or against another layer of material, the layers can be said to be directly coupled.

Objects or structures described herein as being "adjacent to" each other may be in physical contact with each other, in close proximity to each other, or in the same general region or area as each other, as appropriate for the context in which the phrase is used.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the term "about" is used to provide flexibility to a numerical range endpoint by providing that a given value may be "a little above" or "a little below" the endpoint. However, it is to be understood that even when the term "about" is used in the present specification in connection with a specific numerical value, that support for the exact numerical value recited apart from the "about" terminology is also provided.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 1.5, 2, 2.3, 3, 3.8, 4, 4.6, 5, and 5.1 individually.

This same principle applies to ranges reciting only one numerical value as a minimum or a maximum. Furthermore, such an interpretation should apply regardless of the breadth of the range or the characteristics being described.

Reference throughout this specification to "an example" means that a particular feature, structure, or characteristic described in connection with the example is included in at least one embodiment. Thus, appearances of the phrases "in an example" in various places throughout this specification are not necessarily all referring to the same embodiment.

Example Embodiments

An initial overview of technology embodiments is provided below and specific technology embodiments are then described in further detail. This initial summary is intended to aid readers in understanding the technology more quickly, but is not intended to identify key or essential technological features, nor is it intended to limit the scope of the claimed subject matter.

Semiconductive light sources are gaining in popularity because of their high efficiency, ability to gain full brightness instantaneously, environmentally friendly nature, and the ability to control color and brightness levels. Despite this, semi-conductive light sources provide unidirectional light emission that limits their desirability in decorative lighting. Presented herein is a decorative lighting device that allows for multi-directional light emission from a semiconductive light source that, in some cases, has a natural or incandescent light effect.

The present disclosure, in one example, provides a decorative lighting device including a translucent post configured to propagate light from a semiconductive light source at a basal end along a linear axis to an apical end of the translucent post when in use. The translucent post can include a center emission surface at the apical end on the linear axis configured to emit a center portion of the light, a circumferential emission surface obliquely oriented between the semiconductive light source and the center emission surface configured to emit a circumferential portion of the light, and a radially-oriented emission surface extending along the translucent post between the basal end and the circumferential emission surface configured to emit a radial portion of the light. When in use, as light from the semiconductive light source is propagated through the translucent post, the radial, circumferential, and center portions of the light are emitted to create an incandescent visual effect.

Figure 1B:
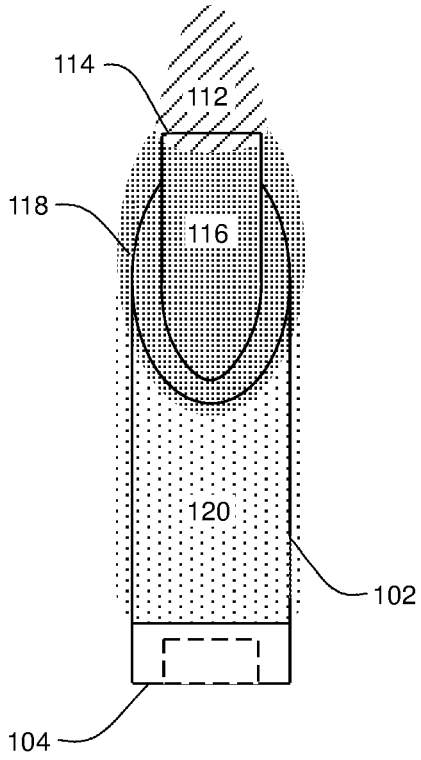
FIG. 1B illustrates a view of a translucent post in accordance with one example of the present disclosure.

FIG. 1*a* shows an example of a transparent post 102 coupled to a semiconductive light source, such as a light-emitting diode (LED) 104, for example. While the term "LED" is used herein to described semiconductive light sources, such is merely for convenience. It should be understood that any type semiconductive light source is contemplated, such as laser diodes, for example. The translucent post 102 is configured to propagate light 106 from the LED 104 at a basal end 108 along a linear axis to an apical end 110 of the translucent post 102 when in use. A center portion 112 of the light 106 is emitted from a center emission surface 114 at the apical end 110 on the linear axis of the transparent post 102. A circumferential portion 116 of the light 106 is emitted from a circumferential emission surface 118 that is obliquely oriented relative to the linear axis of the translucent post 102, and is located between the LED 104 and the center emission surface 114. A radial portion 120 of the light 106 is emitted from a radially-oriented emission surface 122 extending around and along the translucent post 102 between the basal end 108 and the circumferential emission surface 118, and in some examples, from a portion of the translucent post 102 between the circumferential emission surface 118 and the center emission surface 114. FIG. 1*b* shows a view of the translucent post 102 rotated 90 degrees, and showing an approximation of the emissions of the center portion 112 of the light 106, the circumferential portion 116 of the light 106, and radial portion 120 of the light 106. These different emissions of light combine to create an incandescent visual effect approximated by the shaded areas of FIG. 1, with the darkness of the shading depicting differences in light intensity.

Various similar visual effects can be created using translucent posts having different emission surfaces and surface configurations. For example, the translucent post can be cut and/or shaped to create different lighting patterns that enhance, diminish, or otherwise alter various portions of the emitted light compared to others, which can be used to generate different visual effects. Additionally, various emission surfaces can be configured to additionally alter the light being emitted therefrom. For example, the center emission surface emits a center portion of light that can vary depending on the surface configuration. For example, emission from a flat surface will produce a different emission pattern compared to a contoured surface, or a contoured surface with a surface texture. The same effects would be noted for the circumferential emission surface, and in some cases the radially-oriented emission surface.

Figure 2A:
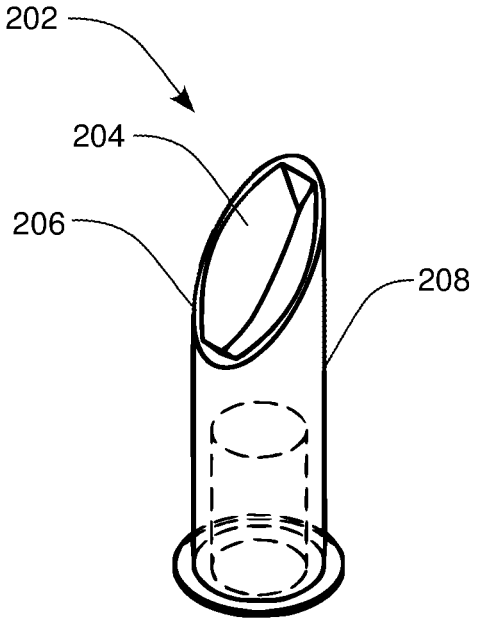
FIG. 2A illustrates a view of a translucent post in accordance with one example of the present disclosure.
Figure 2B:
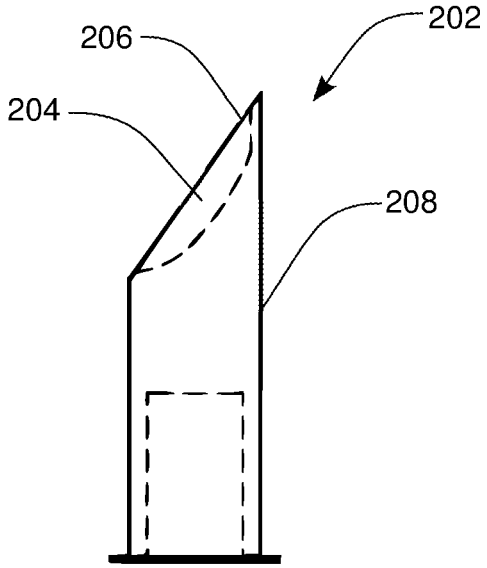
FIG. 2B illustrates a view of a translucent post in accordance with one example of the present disclosure.
Figure 3A:
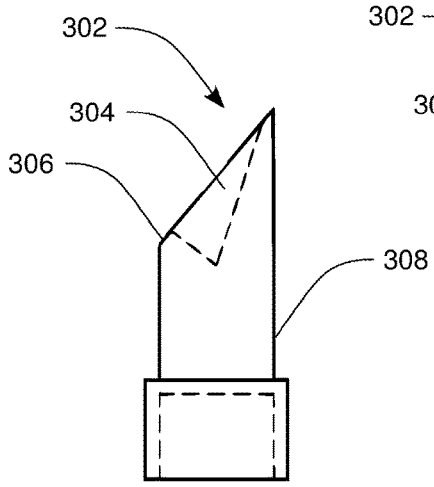
FIG. 3A illustrates a view of a translucent post in accordance with one example of the present disclosure.
Figure 3B:
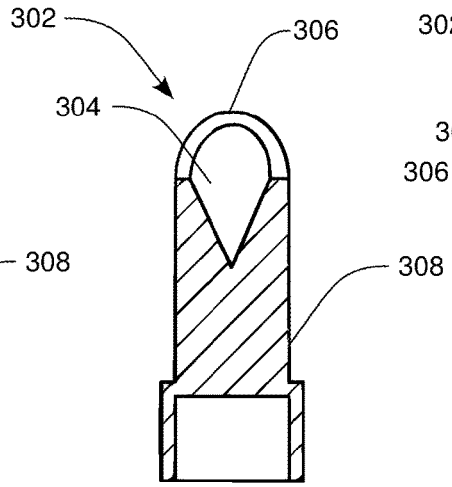
FIG. 3B illustrates a view of a translucent post in accordance with one example of the present disclosure.
Figure 3C:
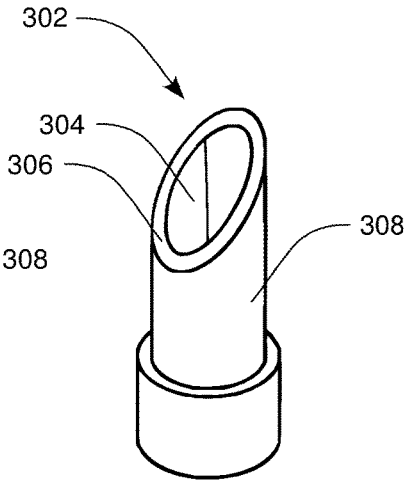
FIG. 3C illustrates a view of a translucent post in accordance with one example of the present disclosure.

Any surface contouring, when present, is not particularly limited, and can be designed to propagate aesthetically pleasing light emissions, or in other words, visual lighting effects that can be more natural compared to LED light, or any other type of visual effect that differs from what is generally observed from LED light. In some examples, the contoured surface can include an indentation pointing toward the basal end of the translucent post. Such an indentation can, in some examples, increase the percentage of emission from the emission surface. Exemplary configurations are shown in FIGS. 2A, 2B, 3A, 3B, and 3C. As shown in FIGS. 2A and 2B, the translucent post 202 can include a center emission surface 204 with an indentation, a circumferential surface 206 facing upward and surrounding the center emission surface, and a radially-oriented emission surface 208. The center emission surface in FIGS. 2A and 2B forms a shape that resembles an inverted triangular prism. When referring to the indentation as having an "inverted shape" the form of the center emission surface would allow that shape to fit inside the indentation, e.g. the configuration forms a negative of the shape. As shown in FIGS. 3A, 3B, and 3C, the translucent post 302 can include a center emission surface 304 with an indentation, a circumferential surface 306, and a radially-oriented emission surface 308. The center emission surface shown in these figures is similar to an inverted oblique cone shape, although such is not limiting. In yet other examples, an indentation surface can be in the shape of an inverted cone, an inverted pyramid, an inverted semi-sphere, or any other inverted geometric or nongeometric shape.

It is noted that numerous waveguide designs can be utilized to in forming various emission surfaces to generate desirable lighting effects, and as such, any waveguide or surface contour configuration capable of generating such effects are considered to be within the present scope. In one non-limiting example, however, the angle from the top point of the center emission surface to the bottom point of the center emission surface can be from about 45° to about 135°, or from about 75° to about 105°, or from about 85° to about 95°.

Figure 4A:
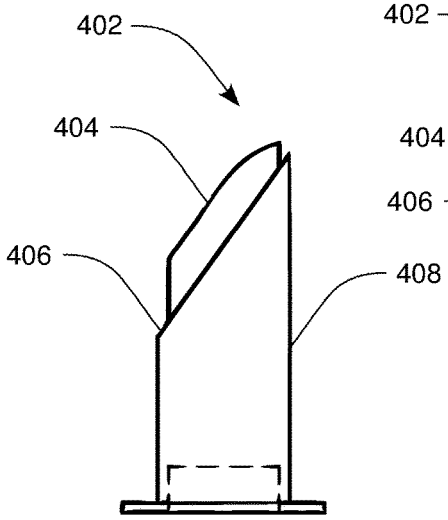
FIG. 4A illustrates a view of a translucent post in accordance with one example of the present disclosure.
Figure 4B:
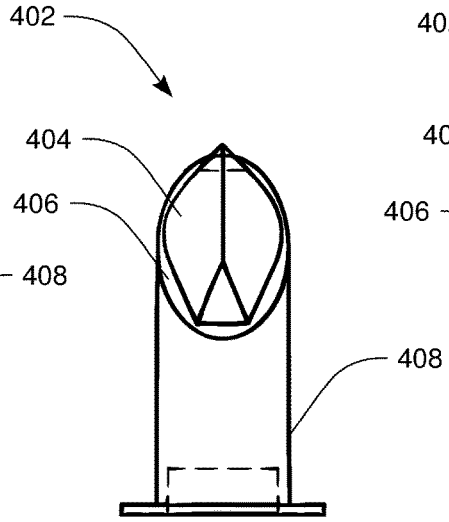
FIG. 4B illustrates a view of a translucent post in accordance with one example of the present disclosure.
Figure 4C:
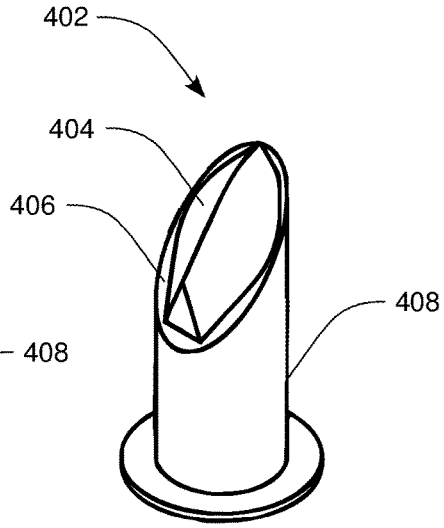
FIG. 4C illustrates a view of a translucent post in accordance with one example of the present disclosure.

In yet other examples, the contoured surface of the center emission surface can be a raised portion extending away from the basal end of the translucent post. For example, the contoured surface can include any geometric shape, including cones, 3 and 4-sided pyramids, semi-spheres, multifaceted shapes, or any other geometric or nongeometric shape. One nonlimiting example is shown in FIGS. 4A, 4B, and 4C, where the translucent post 402 includes a center emission surface 404 resembling a triangular prism. The translucent post 402 additionally includes a circumferential emission surface 406 and a radially-oriented emission surface 408.

As described above, the surface of the any of the emission surfaces can include a surface texture. Nonlimiting examples can include facetted surfaces, diffusive textures, parabolic textures, ringed grooving, and the like. A textured surface can be used to alter various properties of the emitted light, including the directionality, the intensity, the spatial distribution, and the like.

Figure 5A:
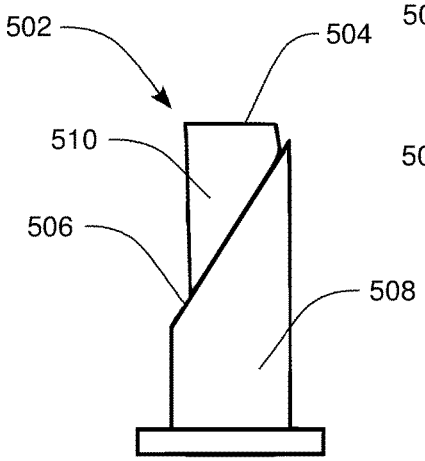
FIG. 5A illustrates a view of a translucent post in accordance with one example of the present disclosure.
Figure 5B:
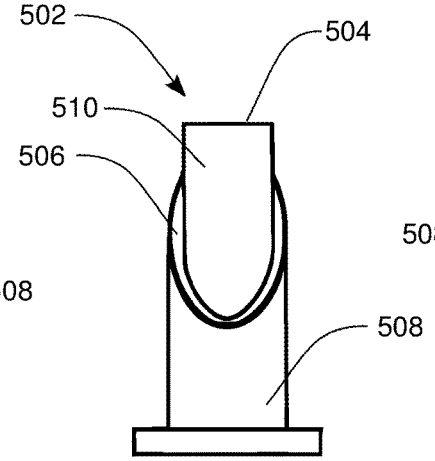
FIG. 5B illustrates a view of a translucent post in accordance with one example of the present disclosure.
Figure 5C:
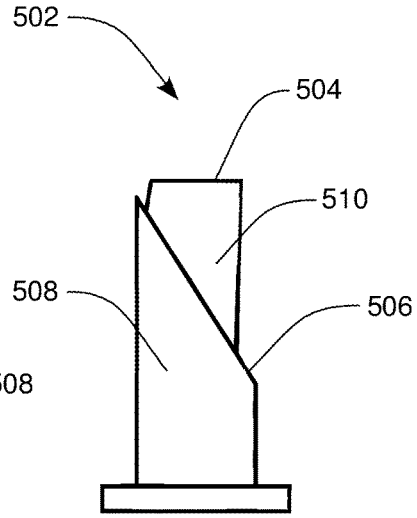
FIG. 5C illustrates a view of a translucent post in accordance with one example of the present disclosure.
Figure 6A:
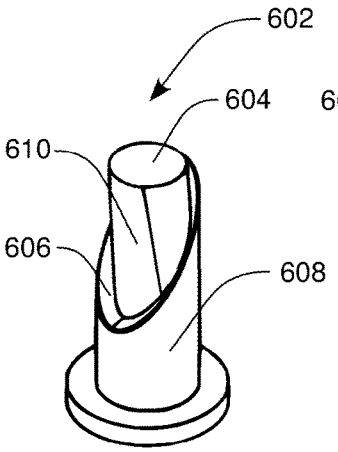
FIG. 6A illustrates a view of a translucent post in accordance with one example of the present disclosure.
Figure 6B:
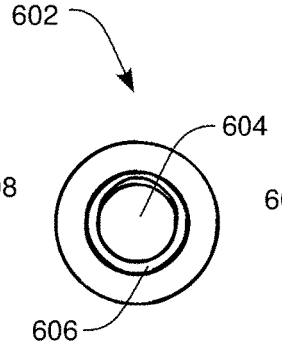
FIG. 6B illustrates a top view of a translucent post in accordance with one example of the present disclosure.
Figure 6C:
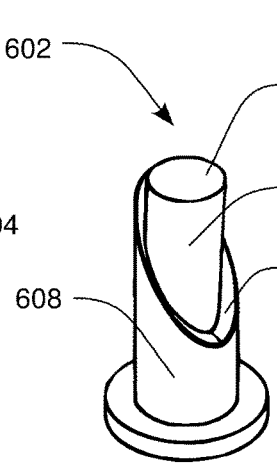
FIG. 6C illustrates a view of a translucent post in accordance with one example of the present disclosure.
Figure 6D:
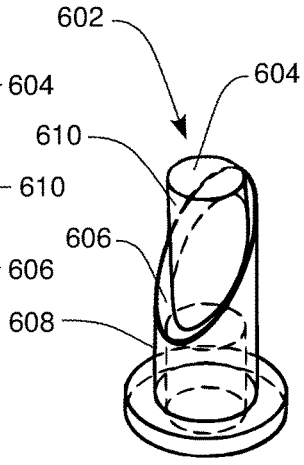
FIG. 6D illustrates a view of a translucent post in accordance with one example of the present disclosure.
Figure 7A:
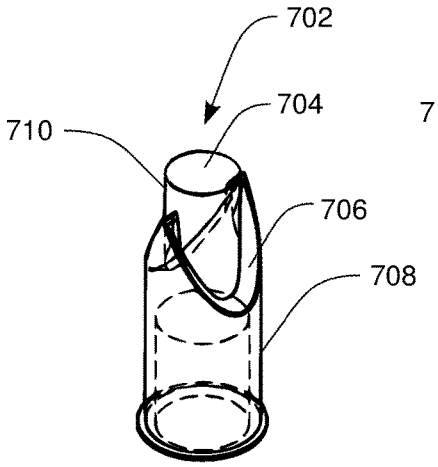
FIG. 7A illustrates a view of a translucent post in accordance with one example of the present disclosure.
Figure 7B:
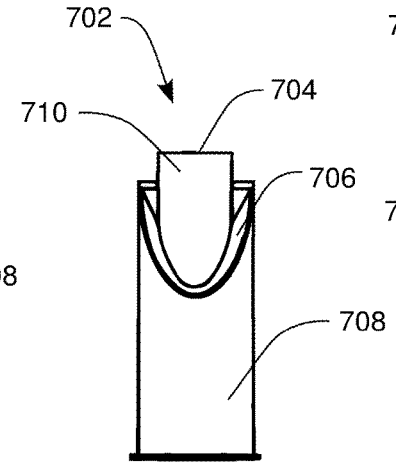
FIG. 7B illustrates a view of a translucent post in accordance with one example of the present disclosure.
Figure 7C:
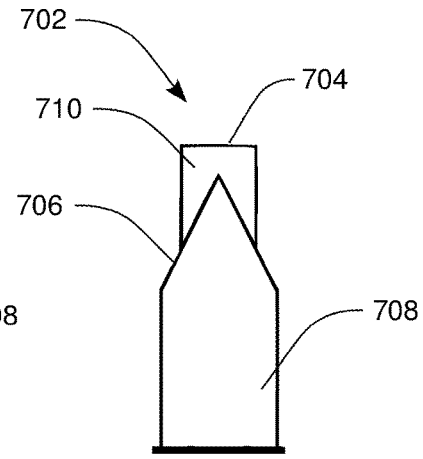
FIG. 7C illustrates a view of a translucent post in accordance with one example of the present disclosure.
Figure 7D:
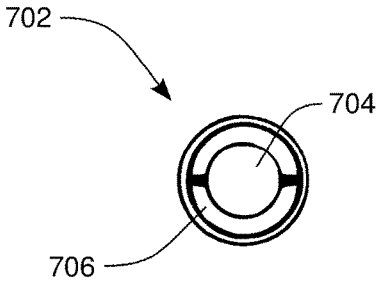
FIG. 7D illustrates a top view of a translucent post in accordance with one example of the present disclosure.
Figure 7E:
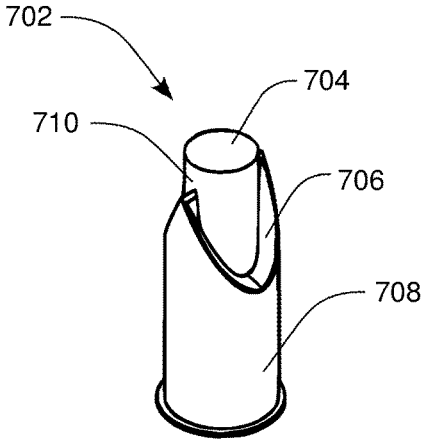
FIG. 7E illustrates a view of a translucent post in accordance with one example of the present disclosure.
Figure 8A:
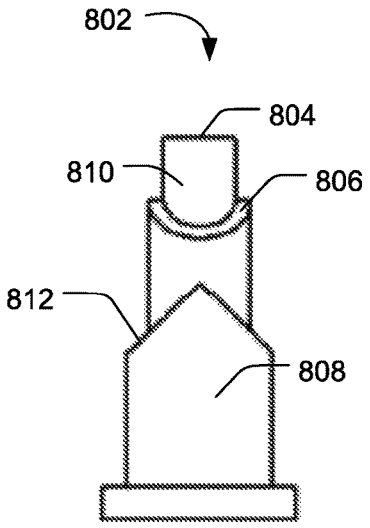
FIG. 8A illustrates a view of a translucent post in accordance with one example of the present disclosure.
Figure 8B:
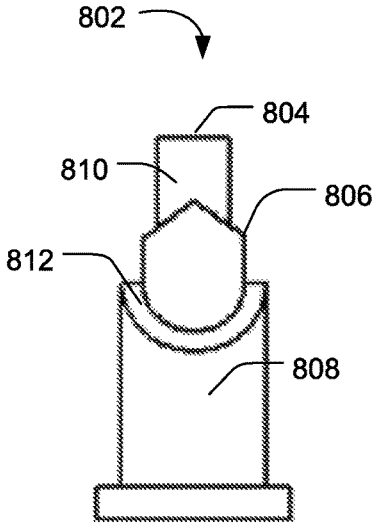
FIG. 8B illustrates a view of a translucent post in accordance with one example of the present disclosure.
Figure 8C:
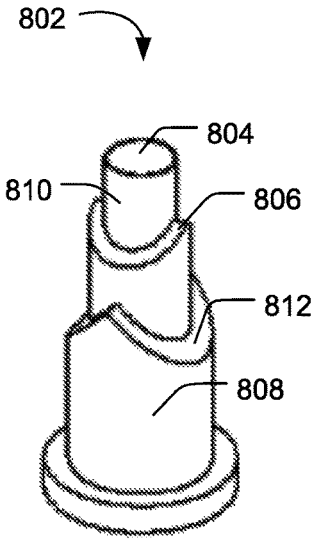
FIG. 8C illustrates a view of a translucent post in accordance with one example of the present disclosure.
Figure 8D:
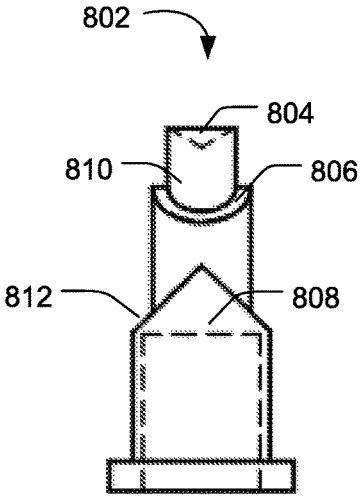
FIG. 8D illustrates a view of a translucent post in accordance with one example of the present disclosure.
Figure 8E:
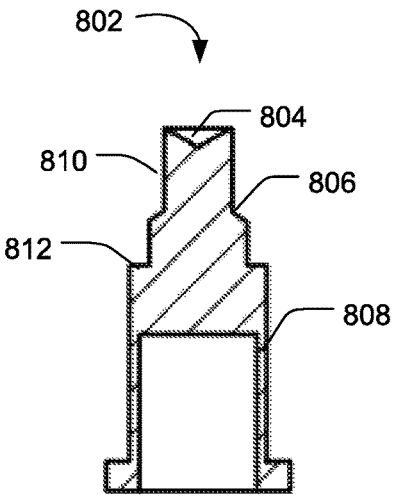
FIG. 8E illustrates a view of a translucent post in accordance with one example of the present disclosure.
Figure 8F:
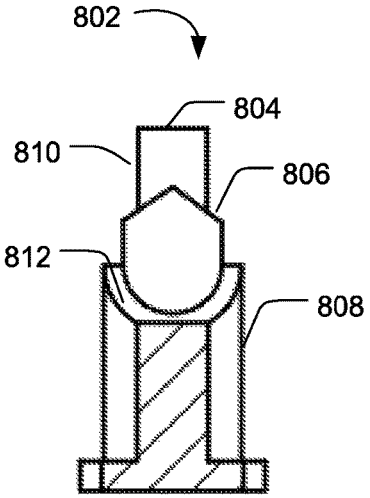
FIG. 8F illustrates a view of a translucent post in accordance with one example of the present disclosure.

The circumferential emission surface of the translucent post can be obliquely oriented relative to the linear axis of the transparent post, and located between the basal end and the center emission surface. The circumferential emission surface can be configured to emit a circumferential portion of the light, and can have a surface structure that can symmetrical or asymmetrical across the linear axis, depending on the viewing angle. For example, in FIG. 5A and 5C, the surface structure of the circumferential emission surface 506 is at an asymmetrical oblique angle to the linear axis of the translucent post 502 when viewed from either of these directions, while in FIG. 5B the surface structure is symmetrically oblique when viewed from this angle. The translucent post 502 additionally includes a center emission surface 504, a radially-oriented emission surface 508, and an apical emission surface 510 (described below). FIGS. 6A-6D illustrate yet another example showing details of a translucent post 602, including a center emission surface 604, a circumferential emission surface 606, a radially-oriented emission surface 608, and an apical emission surface 610. In yet another example, FIG. 7A-7E show views of a translucent post 702 including a center emission surface 704, a circumferential emission surface 706, a radially-oriented emission surface 708, and an apical emission surface 710. The circumferential emission surface 706 in this example is oriented along multiple oblique angles from the linear axis, which can create a variable visual effect depending on the viewing angle.

The shape of the circumferential emission surface can determine the amount of light and the direction of light propagated out of that surface. In addition, a distance between the center emission surface and the circumferential emission surface can create an emission angle which can allow for light emission along different portions of the translucent post creating more natural visual lighting effects compared to LED light alone. The emitted light can be further altered based on the surface of the circumferential emission surface which can be smooth or can be textured.

The radially-oriented emission surface of the translucent post can extend along the translucent post between the basal end and the circumferential emission surface, and can be configured to emit a radial portion of light. In yet other examples the radially-oriented emission surface can extend along the translucent post between the circumferential emission surface and the apical end (described below). The radially-oriented emission surface can emit light extending around the circumference and along the length of the translucent post.

The radially-oriented emission surface can include a basal radius located at or near the basal end of the translucent post and an apical radius located at or near the apical end of the translucent post. In some examples, the basal radius and the apical radius can be the same radius. In yet other examples, the basal radius and the apical radius can be different, with the basal radius being longer than the apical radius. The difference between these two radii is due to the removal of material from the translucent post in the formation of the circumferential emission surface. It is additionally contemplated that multiple circumferential emission surfaces can be utilized, thus creating additional radially-oriented surfaces.

In some examples, the intensity of light emitted from the radially-oriented emission surface can be lower than the intensity of light emitted from the center emission surface and/or the circumferential emission surface, which may be attributed to the angle of incidence of the light along the radially-oriented emission surface. This can result in the radially-oriented emission surface having a soft glow when the light is propagated through the translucent post.

In yet other examples, the translucent post can further include additional circumferential emission surfaces. For example, the translucent post can include an exterior circumferential emission surface, radially oriented exterior to the circumferential emission surface and positioned between the semiconductive light source and the circumferential emission surface. The exterior circumferential emission surface can be configured to propagate an exterior circumferential portion of the light. An exemplary exterior circumferential emission surface can be seen in FIGS. 8A-8F. As illustrated, an exemplary lower circumferential emission surface 812 can be located between the circumferential emission surface 806 and the basal end of the translucent post 802. Also illustrated are the translucent post 802, center emission surface 804, radially-oriented emission surface 808, and an apical emission surface 810. The lower circumferential emission surface can be as previously described with respect to the circumferential emission surface. The inclusion of multiple circumferential emission surfaces can be desirable in order to create a more aesthetically pleasing light emission which can be a result of the increased emission surfaces and/or the interaction between light propagated at different angles from the translucent post.

In some examples, the translucent post can be completely transparent; while in other examples, the translucent post can have a degree of transmission that is less than 100%. For example, the translucent post can be semitransparent and can have a degree of transparency ranging from 0.1% to 99.9%. In yet other examples, the degree of transparency can be from 0.1% to 100%, from 25% to 75%, from 50% to 99%, or from 65% to 85%. In yet other examples, a portion of the translucent post can be opaque and another portion of the translucent post can be translucent. For example, a portion near the basal end of the translucent post that accepts a semiconductive light source can be opaque while the remainder of the post can be translucent. In no instance will the entire translucent post block 100% of the light, i.e. be opaque. In general, the higher the degree of transparency the more apparent the emitted light will be.

The translucent post can be designed according to a variety of configurations, all of which are considered to be within the present scope. The translucent post can be created from a single material piece or from multiple material pieces. For example, the translucent post can be an extruded or molded article. In another example, a single piece of material can be cut or carved away in order to create the shape of the translucent post. In other examples, the translucent post can include an inner post and an outer post wherein the inner post can be positioned interior of the outer post. The inner post can include the apical end of the translucent post and the center emission surface and the outer post can include the basal end of the translucent post, the circumferential emission surface, and the radially-oriented emission surface. The inner post can be nested within the outer post and can be coupled to the outer post in a manner that reduces stray light emission.

The translucent post can be created from any variety of translucent materials. For example, the translucent post can be created from a polymer, polycrystalline, ceramic, glass, or a combination thereof. In some examples, the translucent post can be a composite, where the inner portion and the outer portion are distinct materials. In one example, the material of the outer portion can be different from the material of the inner portion, the outer portion can be transparent, translucent, or opaque.

Figure 9:
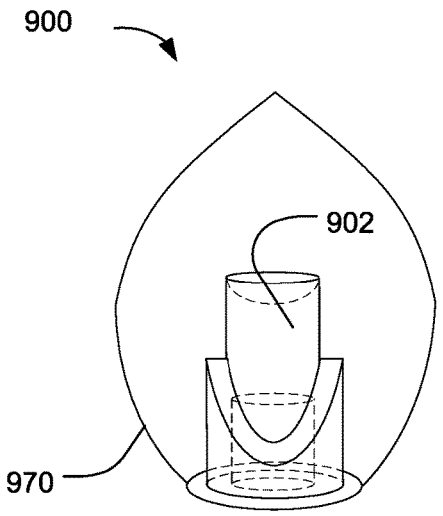
FIG. 9 illustrates a view of a shield and a translucent post in accordance with one example of the present disclosure.

In further examples, the decorative lighting device can include further enhancements, such as a shield, a light source, and/or electrical components. When present, the shield can surround and can be spaced apart from the translucent post. The shield can be coupled to the translucent post at the basal end. An exemplary lighting device 900 including a translucent post 902 and shield 970 are shown in FIG. 9. The configuration of the shield is not particularly limited, and can include mini-light, spherical globe, teardrop-C7/C9, candle-lamp, a specialty shape, or any combination thereof. An exemplary specialty shape can include the shape of an icicle or starburst. Depending on the desired effect, the shield can have a smooth surface or a textured surface, such as a faceted surface and/or the shield can be translucent, colored, or opaque. In one example, the shield can be coupled to the translucent post, and later attached to a light source. As such, the basal end of the translucent post can be configured to couple to a standard LED light configuration.

Figure 10:
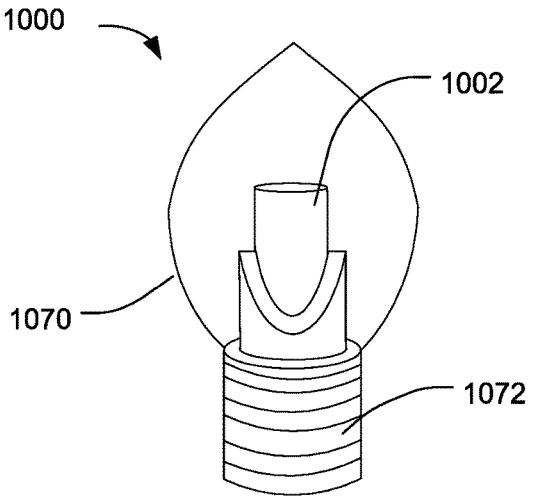
FIG. 10 illustrates a view of a shield, a translucent post, and a socket in accordance with one example of the present disclosure.
Figure 11:
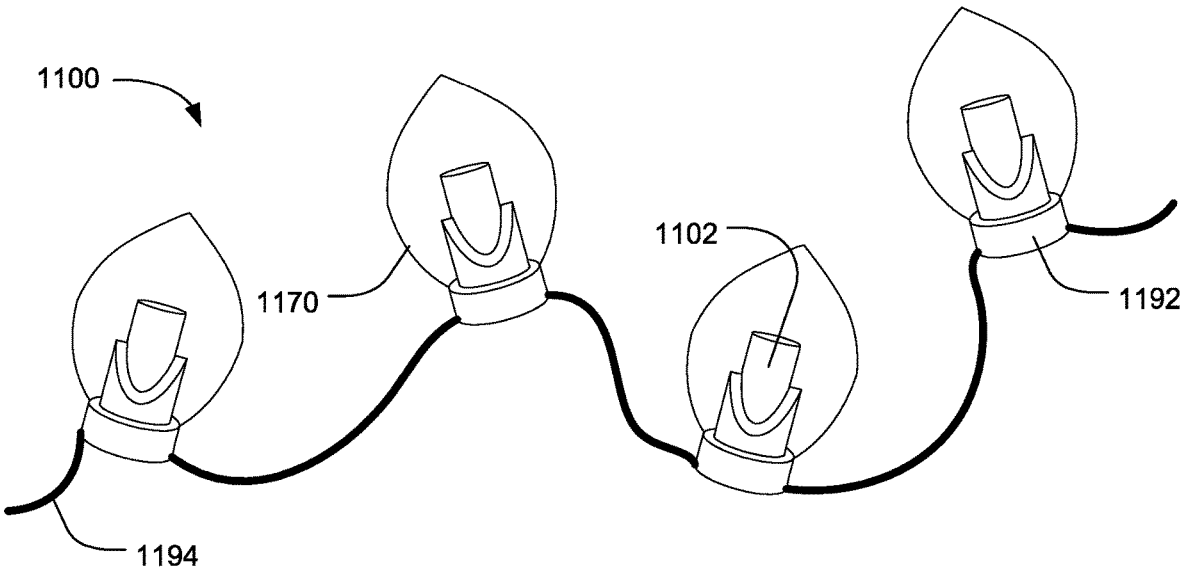
FIG. 11 illustrates a view of a light strand in accordance with one example of the present disclosure.

In yet another example, the decorative lighting device can further include the semiconductive light source. The semiconductive light source can be coupled to the translucent post either beneath or inside of the basal end of the translucent post. In a further example, the decorative lighting device can further include electrical components, including an electrical connection for connecting to an electrical light socket, a socket, wiring, cord, a plug, and the like. In some examples, a decorative lighting device 1000 can incorporate electrical components including a shield 1070, a translucent post 1002, and a socket 1072, as shown in FIG. 10. In yet another example, a decorating lighting system 1100 can include a plurality of lights as described, including shields 1170, translucent posts 1102, socket bases 1192, wiring 1194, and the like, as shown in FIG. 11.

What is claimed is:

1. A decorative lighting device, comprising:

a translucent post configured to propagate light from a semiconductive light source at a basal end along a linear axis of the translucent post to an apical end of the translucent post when in use, the translucent post comprising;

a center emission surface at the apical end on the linear axis configured to emit a center portion of the light;

a circumferential emission surface obliquely oriented relative to the linear axis between the semiconductive light source and the center emission surface configured to emit a circumferential portion of the light, wherein the circumferential emissions surface includes multiple circumferential emission surfaces oriented at different oblique angles to the linear axis; and a radially-oriented emission surface extending along the translucent post between the basal end and the circumferential emission surface configured to emit a radial portion of the light;

wherein as light from the semiconductive light source is propagated through the translucent post, the radial, circumferential, and center portions of the light are emitted to create an incandescent visual effect.

2. The device of claim 1, wherein the center emission surface comprises a contoured surface including an indentation toward the basal end.

3. The device of claim 2, wherein the contoured surface is structurally configured to increase emission of the center portion of the light compared to an emission that would emit from a planar center emission surface.

4. The device of claim 2, wherein the indentation can include an indentation surface in the shape of an inverted cone.

5. The device of claim 1, wherein the translucent post has a basal radius located at the basal end that differs in length from a length of an apical radius located at the apical end.

6. The device of claim 5, wherein the translucent post further includes an apical emission surface positioned between the center emission surface and the circumferential emission surface and configured to emit an apical radially-oriented portion of the light.

7. The device of claim 1, wherein the radially-oriented emission surface extends from the semiconductive light source to the center emission surface.

8. The device of claim 1, wherein the radially-oriented emission surface emits the radial portion of the light around the full circumference of the translucent post.

9. The device of claim 1, further comprising a shield surrounding and spaced apart from the translucent post and wherein the shield is coupled to the translucent post at the basal end.

10. The device of claim 1, further comprising an inner post and an outer post wherein the inner post is positioned interior of the outer post;

wherein the inner post comprises the apical end of the translucent post and the center emission surface; and wherein the outer post comprises the basal end of the translucent post, the circumferential emission surface, and the radially-oriented emission surface.

11. The device of claim 1, further comprising an exterior circumferential emission surface, radially oriented exterior to the circumferential emission surface and positioned between the semiconductive light source and the circumferential emission surface and configured to emit an exterior circumferential portion of the light.

12. The device of claim 1, further comprising the semiconductive light source coupled at the basal end of the translucent post, and oriented to deliver light into the translucent post.

13. The device of claim 12, wherein the semiconductive light source is a member selected from the group consisting of a light-emitting diode, a laser diode, and a combination thereof.

14. The device of claim 12, further comprising an electrical connector coupled to the semiconductive light source.

15. A decorative lighting device, comprising:

a translucent post configured to propagate light from a semiconductive light source at a basal end along a linear axis to an apical end of the translucent post when in use, the translucent post comprising;

a center emission surface at the apical end on the linear axis configured to emit a center portion of the light;

a circumferential emission surface obliquely positioned between the semiconductive light source and the center emission surface configured to emit a circumferential portion of the light, wherein the circumferential emissions surface includes multiple circumferential emission surfaces oriented at different oblique angles to the linear axis; and a radially-oriented emission surface extending along the translucent post between the basal end and the circumferential emission surface configured to emit a radial portion of the light;

wherein as light from the semiconductive light source is propagated through the translucent post, the radial portion, the circumferential portion, and the center portion emit light that creates an incandescent visual effect;

the semiconductive light source coupled at the basal end of the translucent post, and oriented to deliver light into the translucent post; and a shield surrounding and spaced apart from the translucent post, the shield coupled to the translucent post at the basal end.

16. The device of claim 15, wherein the device further includes an electrical connector coupled to the semiconductive light source and configured to provide electricity to the semiconductive light source.

17. The device of claim 16, wherein the device is a strand of lights.

18. The device of claim 15, wherein the semiconductive light source is a member selected from the group consisting of a light-emitting diode, a laser diode, and a combination thereof.

19. The device of claim 15, wherein the center emission surface comprises a contoured surface including an indentation toward the basal end; and wherein the circumferential emission surface includes a surface structure that comprises a member selected from the group consisting of an oblique angle, obliquely linear, obliquely symmetrical, obliquely nonlinear, obliquely asymmetrical, parabolic, linear, and a combination thereof.

* * * * *